United States Patent [19]

Simons et al.

[11] Patent Number: 4,764,444

[45] Date of Patent: Aug. 16, 1988

[54] TRANSFER ELEMENT WITH MOSAIC PATTERN OF HEAT TRANSFERABLE DYES

[75] Inventors: Michael J. Simons, Harrow, England; Roland G. Willis; Donald M. Harvey, both of Rochester, N.Y.

[73] Assignee: Eastman Kodak Company, Rochester, N.Y.

[21] Appl. No.: 919,511

[22] Filed: Oct. 16, 1986

[51] Int. Cl.[4] ..... G03C 5/54; G03C 7/00; G03G 5/12; G03G 13/01

[52] U.S. Cl. ..... 430/47; 430/42; 430/200; 430/201; 430/254; 430/338; 346/150; 346/164; 346/135.1; 346/76 PH

[58] Field of Search ..... 430/200, 201, 254, 47, 430/42, 46, 338; 346/150, 164, 135.1, 76 PH

[56] References Cited

U.S. PATENT DOCUMENTS 3,780,214 12/1973 Bestenreiner et al. ..... 178/5.2 R
3,859,094 1/1975 Franer et al. ..... 430/200
4,006,018 2/1977 Wiese, Jr. ..... 430/201
4,395,718 7/1983 Murayama et al. ..... 346/135.1
4,568,621 2/1986 Aviram et al. ..... 430/200

FOREIGN PATENT DOCUMENTS 0219744 12/1984 Japan ..... 430/203

*Primary Examiner*—Richard L. Schilling
*Attorney, Agent, or Firm*—Paul L. Marshall

[57] ABSTRACT

A color transfer imaging element comprising a support having thereon an imaging layer comprising a thermographic, photothermographic, or electrographic material capable of forming an image which absorbs or scatters light or infrared radiation, and a dye layer from which a dye image can be transferred to an image receiver when the imaging element is overall exposed to radiation that is absorbed or scattered by the imaged areas of the imaging layer, thereby causing imagewise heating of the dye. The dye layer is positioned relative to the other layers so as to allow this imagewise transfer of dye to the image receiver.

13 Claims, 2 Drawing Sheets

FIG. 1
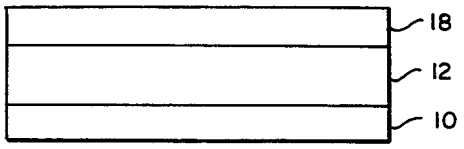
FIG. 2
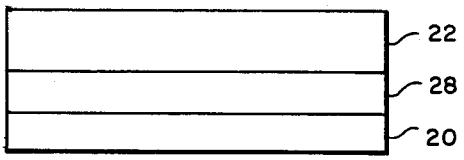
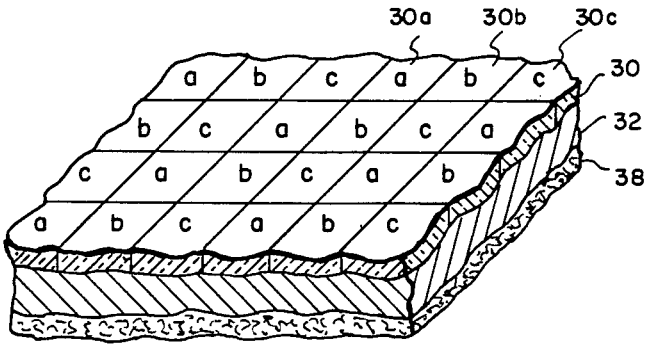
FIG. 3

TRANSFER ELEMENT WITH MOSAIC PATTERN OF HEAT TRANSFERABLE DYES

FIELD OF THE INVENTION

This invention relates to a color transfer imaging element capable of thermal image transfer to an image-receiving material.

BACKGROUND OF THE INVENTION

Color imaging thermal transfer elements capable of transferring electronically stored image information onto an image support as a color image generally require time-consuming separate heating steps for at least each primary color of the image. For example, U.S. Pat. No. 4,395,718 discloses a thermal transfer color recording medium having a mosaic pattern of different color dyes having a different melting point for each color. Transfer of a color image to an image support requires individually heating the various colored dyes in the mosaic with a heating head.

Processes such as the one described above require time-consuming multiple heating steps to cause image transfer. Thus, there is a need for a color imaging element capable of quick and easy thermal image transfer. It is toward such a color imaging thermal transfer element capable of transferring electronically stored image information onto an image support as a color image that the present invention is directed.

SUMMARY OF THE INVENTION

The color transfer imaging element of the invention comprises a support having thereon an imaging layer comprising a thermographic, photothermographic, or electrographic material capable of forming an image that absorbs or scatters light or infrared radiation, and a heat-transferable dye layer from which a dye image can be transferred to a dye image receiver when the imaging element is overall exposed to light or infrared radiation that is absorbed or scattered as a function of the imaged areas of the imaging layer, thereby causing selective heating of the dye layer of the element. The dye layer comprises a mosaic dye pattern of at least two colors and is positioned relative to the other layers so as to allow imagewise transfer of the dye to the image receiver.

In one embodiment of the invention, the dyes of the dye layer are sublimable. In alternative embodiments, the element comprises a thermal adhesive layer as an exterior face of the element adjacent to the dye layer or the dye layer itself is thermally adhesive.

The color transfer imaging element of the invention is used to transfer an image to an image receiver by first selectively exposing the imaging layer of the element to form an infrared- or light-absorbing or -scattering image corresponding to a desired dye image, the absorbtion of the infrared- or light-absorbing or -scattering image varying inversely with the amount of dye desired to be transferred. If the element does not already comprise an image receiver, the element is juxtaposed with an image receiver so that dye transfer can take place. The infrared- or light-absorbing or -scattering image is then overall exposed to light or infrared radiation at an intensity and for a time sufficient to cause imagewise transfer of dye to the image receiver.

BRIEF DESCRIPTION OF THE DRAWINGS

FIGS. 1 and 2 represent imaging elements of the invention having alternative layer configurations.

FIG. 3 represents an imaging element of the invention having a sublimable dye layer arranged in a mosaic pattern.

DESCRIPTION OF THE PREFERRED EMBODIMENTS

Figure 4:
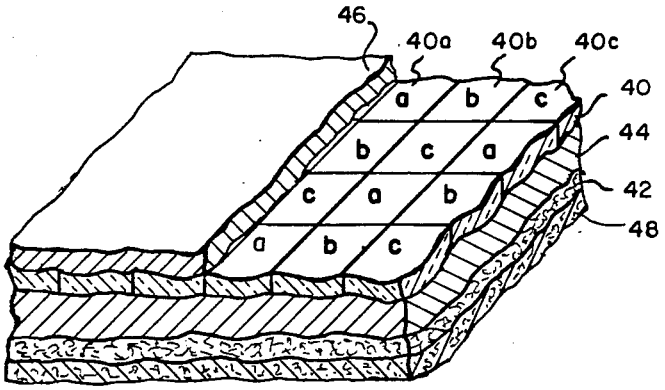
FIG. 4 represents an imaging element of the invention having a thermal adhesive layer adjacent to the dye layer.

Referring to FIGS. 1 and 2, there is shown a support 12 or 22 having thereon a dye layer 10 or 20 capable of transferring an image to an image-receiving material upon overall exposure to radiation and a thermographic, photothermographic, or electrographic layer 18 or 28. The layers of the color transfer imaging element of the invention are positioned such that the dye layer 10 or 20 is not between thermographic, photothermographic, or electrographic layer 18 or 28 and the support 12 or 22.

In one embodiment of the present invention as shown in FIG. 3, there is a support 32 having on one side a dye layer 30 capable of image transfer upon overall exposure to radiation, and on the other side a thermographic, photothermographic, or electrographic layer 38. The dye layer 30 comprises a three-color mosaic pattern of sublimable dyes 30*a*, 30*b*, and 30*c* dispersed in a binder on support 32.

The layers of the imaging element should be positioned so that the dye layer is capable of transferring dye to the image receiver upon overall exposure of the element to light or infrared radiation. The dye layer for example should not be positioned between the support and the thermographic, photothermographic, or electrographic layer. A generally convenient arrangement is to position the thermographic, photothermographic or electrographic layer and the dye layer on opposite sides of a transparent support.

In the embodiment of the present invention in which sublimable dyes are employed, such dyes should be chosen so that the sublimation temperature is high enough to prevent sublimation when heat is applied to the thermographic, photothermographic, or electrographic layer, but low enough to allow sublimation upon exposure to radiation for image transfer. Correspondingly, the material of the thermographic, photothermographic, or electrographic layer should be chosen so that any heat necessarily applied during the selective exposure of that layer would be insufficient to cause significant sublimation. If the dye is unable to absorb sufficient radiation to provide the heat necessary for sublimation, an infrared- or light-absorbing material that heats up upon exposure, such as carbon black, may be uniformly disposed in the heat-transferable dye layer. Exemplary sublimable dyes include the yellow dyes, C.I Solvent Yellow 56,

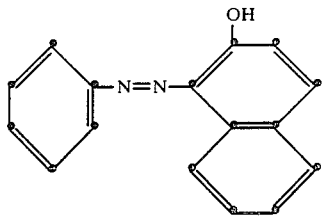

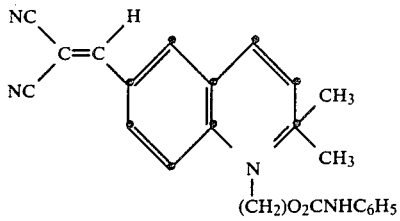

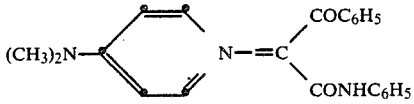

the magenta dyes, C.I. Disperse Red 9,

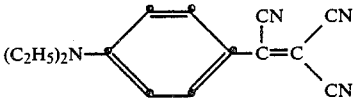

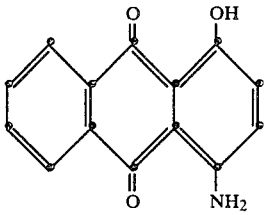

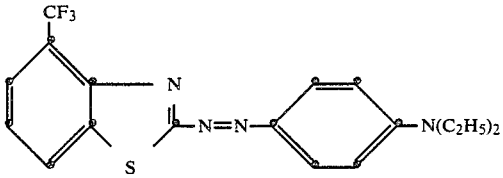

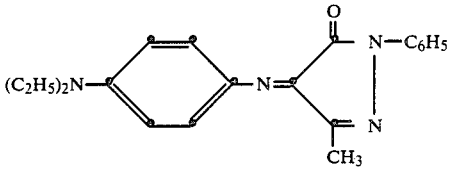

and the cyan dyes, C.I. Solvent Blue 36.

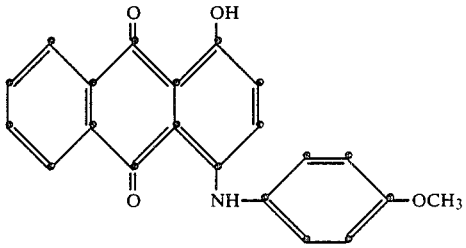

-continued

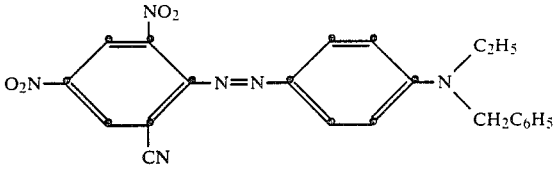

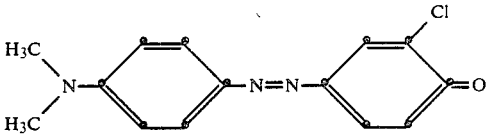

Dye coverages are generally 50–1000 mg/m$^2$ and coverages of the infrared- or light-absorbing material are generally 0–3 g/m$^2$. Further illustration of sublimable dyes that transfer upon infrared or light exposure is provided in *Research Disclosure* 14223, p. 14, February, 1976, and British Pat. No. 1,154,162, the disclosures of which are incorporated herein by reference in their entirety.

In another embodiment of the invention as shown in FIG. 4, the color transfer imaging element comprises a support 42 having thereon thermographic, photothermographic, or electrographic layer 48, a dye layer 40 comprising a three-color mosaic pattern of dyes 40*a*, 40*b*, and 40*c* dispersed in a binder, a thermal adhesive layer 46. In an alternative embodiment, a thermal adhesive is mixed with the dyes, eliminating the need for thermal adhesive layer 46. The dyes in the embodiment represented by FIG. 4 need not be sublimable. Any of a number of well-known dyes can be used in this embodiment. Exemplary dyes include: C.I. Pigment Yellow 12, C.I. Pigment Red 57, and C.I. Pigment Blue 15

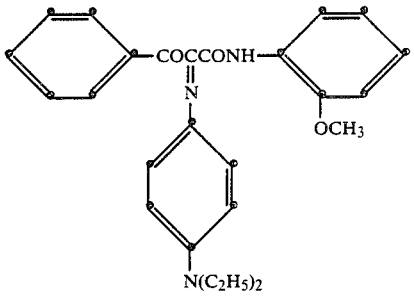

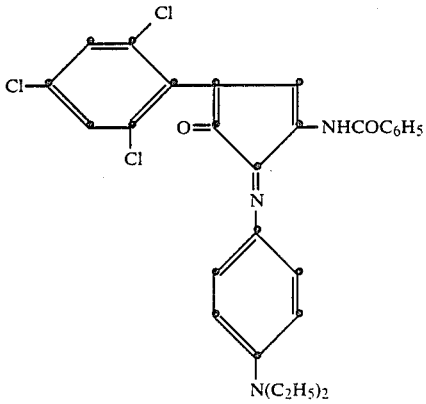

-continued

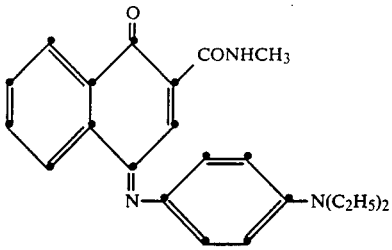

The thermal adhesive acts as an adhesive in the areas where it is heated. During image transfer, as the overall exposure to radiation causes selective heating of the dye layer, the thermal adhesive layer causes the heated areas of the dye layer to preferentially adhere to an adjacently placed image-receiving material. Materials out of which thermal adhesive layers are made are well known in the art and include those described in U.S. Pat. Nos. 3,036,913, 4,126,464, and 4,282,308, the disclosures of which are incorporated by reference herein in their entirety. The element of FIG. 4 may also optionally have a stripping layer between support 42 and dye layer 40. The stripping layer may be a thermal stripping layer, which acts as an adhesive except in heated areas, where it acts as a stripping layer. Materials out of which stripping layers are well known in the art and include those described in U.S. Pat. No. 4,564,577 the disclosure of which is incorporated by reference herein in its entirety.

In a further alternative embodiment, the dye layer melts on heating allowing transfer of the melted areas to form an image on the image receiver. An example of such dye layers are described in UK Patent Specification No. 2,069,160.

The imaging layer comprises a thermographic, photothermographic, or electrographic material generally dispersed in a binder. The thermographic photothermographic, or electrographic layer used in the imaging element of the invention should be capable of forming an infrared- or light-absorbing or scattering image. Exposure to heat causes image formation in the thermographic layer. Exposure to light and heat, or exposure to light followed by an overall heating or heat processing step, causes image formation in the photothermographic layer. Exposure to electric charge or electric charge and heat or exposure to electric charge followed by heat processing causes image formation in the electrographic layer.

Thermographic materials include physical systems, in which a light-scattering layer is made transparent by melting processes, oxidation/reduction color-forming systems such as a silver salt plus a reducing agent, or a leuco dye plus an organic acid, and colour coupling systems such as diazonium salt systems, and are further described in Brinckman, Dezenne, Poot and Willems, *Unconventional Imaging Processes,* Focal Press, London and New York, 1978, as well as in J. Kosar, *Light Sensitive System, pp.* 402–19, John Wiley & Sons, New York, 1965, the disclosures of which are incorporated herein by reference in their entirety. Examples of thermographic materials include silver salts of stearate, behenate, and benzotriazole.

Photothermographic materials include materials based on silver salts, as described in *Research Disclosure,* June 1978, item 17029; materials based on cobalt or other transition metal complexes as exemplified in *Research Disclosure,* June 1980, item 19423; and materials based on tellurium compounds as described by Lelental and Gysling in *J. Phot. Sci.* 28, 209–218 (1980). Exemplary of photothermographic materials are silver behenates, silver bromide, or silver chloride.

Electrographic materials, as defined herein, include electrolytic recording materials (charge-sensitive) as disclosed in Japanese Kokai No. 74-43,648 (*Chemical Abstracts,* 113747, 81, 1974) and electrothermographic (spark discharge-sensitive) as disclosed in Japanese Kokai No. 75-41,554 (*Chemical Abstracts,* 139891, 83, 1975), the disclosures of which are incorporated herein by reference in their entirety.

The support of the element of the invention can be chosen from any of the support materials well-known in the photographic art. The support material should allow enough infrared radiation or light to pass through so as to allow dye transfer upon overall exposure to infrared radiation or light, and is preferably essentially transparent to infrared radiation and light. Exemplary support materials include cellulose triacetate, polyesters, e.g., poly(ethylene terephthalate), poly(vinyl chloride), and polyolefins, e.g., polyethylene.

The dye layer and the imaging layer preferably contain a binder which, for example, can be chosen from any of a number of well-known binders such as ethyl cellulose, vinyl polymers, acrylamide polymers, alkylacrylates and the like. Binder coverages are generally 50–2000 mg/m$^2$ for sublimable dyes, 50–2000 mg/m$^2$ for non-sublimable dyes, and 50–2000 mg/m$^2$ for the imaging layer, although electrographic layers comprising evaporated metal such as aluminum do not require a binder.

The layers employed in the invention may be coated by coating procedures known in the photographic art, including vacuum deposition, sintering, dip coating, air-knife coating, curtain coating, and hopper coating, or by printing procedures such as gravure roll printing. Methods for coating mosaic dye patterns are well-known in the art and include the gravure printing process. Coating solutions can be prepared by mixing the components with suitable solutions or mixtures such as organic solvents using procedures known in the photographic art.

In use, the thermographic layer is selectively exposed to heat such that an infrared- or light-absorbing or scattering pattern corresponding to the dye pattern (such that a color image may be transferred to an image receiver upon overall exposure to light or infrared radiation) in the heat-transferable dye layer is formed. This can be accomplished by any of a number of well-known means such as a thermal head or laser.

If a photothermographic layer is used, it is usually selectively exposed to light followed by heat development. Such light exposure means are well known. The heat development means are also well known and can include heat rollers or a hot air blower. Light and heat may also be simultaneously applied when, for example, a laser is used.

If an electrographic layer is used, it is selectively exposed with electric charge or electric charge and heat by known means.

The selective exposure of imaging layers should be done so that the correct color information is applied to the element in register with the correct color component of the mosaic pattern. This can be achieved by determining the location of the dye pattern with a scanning laser prior to exposure, or by orienting both the mosaic pattern and the selective exposure means to a fixed position on the element, such as perforations. The dye pattern can be oriented to perforations on the element by applying the dye to the element with a lithographic or gravure roll that also functions as a perforating punch roll. When the element is selectively exposed, a sprocket or other sensing mechanism determines the location of the perforations and the selective exposing means is oriented accordingly.

The radiation used to cause image transfer through overall exposure of the element can be provided by any known source of infrared radiation such as an infrared lamp, or a high intensity light flash such as a xenon flashlamp. The duration and temperature or intensity of the radiation source should be sufficient to cause image transfer and, when using sublimable dyes, dye sublimation. The duration and temperature or intensity are easily determined by a simple test on the element. If a high intensity light flash is used, a flash duration of $10^{-6}$ to $10^{-2}$ seconds is preferred with an energy intensity of 0.5 to 10 joules/cm$^2$ of dye.

If the color transfer imaging element has the dyes arranged in a mosaic pattern, each dye spot of the mosaic pattern is preferably small enough to achieve the desired image resolution, e.g. each dye spot may provide one picture element or pixel. The array can comprise yellow, magenta and cyan dyes arranged in dots or stripes and a single image transfer operation will give a full color image on the receiving sheet.

The color balance of the transferred picture will be determined by the intensity of the infrared or light absorbing or scattering image in the thermographic, photothermographic or electrographic layer corresponding to each color of dye. Control of these values should be adjusted for a correctly balanced color picture.

An image receiver may be present in the image transfer element itself as an image receiving layer, or the image receiver may be separate from the image transfer element, such as with an image receiving layer on a reflective support such as paper or a clear support coated with or on a clear film support such as polyethylene terephthalate or cellulose triacetate. The support may be coated with a layer capable of absorbing and retaining the dye image, for instance polyesters, polyvinylchloride, vinylchloride-vinyl acetate copolymers, polyamides, polymers and copolymers of acrylic acid and its derivatives, polyethylene and polypropylene, polyvinylbutyral, polyvinylpyridine and so on. Alternatively, these image-receiving materials may be self-supporting. If the dye used in the dye layer is a metallizable dye capable of chelating with metal ions such as nickel (II) or copper (II), the receiving layer may contain such ions. The receiving layer may also contain, or be adjacent to a layer containing, image stabilizing materials which are known in the photographic art, such as ultraviolet light absorbers and antioxidants.

During image transfer, the color transfer imaging element of the invention and the image receiver are juxtaposed so that the heat-transferable dye element of the color imaging element faces the receiving layer (if any) of the image receiver. If the heat-transferable dye element uses sublimable dyes as in the embodiment shown in FIG. 3, there is preferably face to face contact between the color imaging element and the image-receiving material during image transfer; however, it may sometimes be advantageous to provide a gap of 5 to 50 μm between the dye layer and the image receiver to avoid sticking of the layer to the image receiver after image transfer and to achieve some degree of color dye mixing. If the heat-transferable dye element uses a thermal adhesive layer as in the embodiment shown in FIG. 4, the imaging element and the image support are preferably sandwiched together for image transfer. The invention is further described in the following example.

EXAMPLE

A clear, heat-sensitive layer is coated onto 50 μm thick polyethylene terephthalate film as follows. A solution of 1.0 g of the blocked leuco dye 'Pergasol Black' (Ciba-Geigy) and 3.0 g of a copolymer of vinyl chloride and vinyl acetate (86:14, 'Geon 427') in 100 ml of butanone are blade coated at 0.07 mm wet thickness onto the polyethylene terephthalate film. After gently drying the resulting layer, it is supercoated using a blade at 0.1 mm wet thickness with a solution comprising 0.5 g 2,6-dihydroxybenzoic acid, 0.3 g salicyclic acid and 2.0 g polyvinyl butyral ('Butvar B90') dissolved in 100 ml ethanol. A few drops of 2% solution of polydimethylsiloxane levelling agent are added prior to coating and the layer is dried gently at 25° C.

The film is then printed on the reverse (uncoated) side with a mosaic-patterned dye layer using the gravure printing method. Three different dyes are used; C.I. Disperse Yellow 3; 4-methoxy-2-phenylazonaphthol; and 4-(3-chloro-4-oxophenylideneimino)-N,N'-diethyl-3-methyl-aniline.

The imaging element is then loaded, with its thermal imaging layer facing the print head, into a small thermal printer ('Alphacom 32') driven by a microcomputer ('Sinclair Spectrum'). A computer-generated colour separation negative image is printed onto the thermal layer using variable dot spacing to produce a grey scale. The image thus generated appears black against the colour of the dye layer on the other side of the base.

The dye side of the imaged element is then contacted against a sheet of paper which has been coated with a thin layer of 'Geon 427'. The window of a hammer head photographic flash gun which has been fitted with a small mirror box to give a more even light flux at the window plane is pressed against the thermal layer of the element and the flash gun fired. On separating the imaging element from the receiver sheet, a color image corresponding to a negative of the thermal image is seen to have transferred to the paper. The result is a full coloured image which is then heated overall with a hot air blower to fix it into the image-receiving layer.

The invention has been described in detail with particular reference to preferred embodiments thereof, but it will be understood that variations and modifications can be effected within the spirit and scope of the invention.

What is claimed is:

1. A color transfer imaging element comprising a support having thereon an imaging layer comprising a thermographic, photothermographic, or electrographic material capable of forming an image that absorbs or scatters light or infrared radiation and a heat-transferable dye layer from which a dye image can be transferred to a dye image receiver when said imaging element is overall exposed to light or infrared radiation that is absorbed or scattered as a function of the image areas of said imaging layer, thereby causing selective heating of said dye of the element, said dye layer comprising a mosaic dye pattern of at least two colors of dyes transferable by heat alone having mosaic spots small enough to provide image resolution of a full color image in a single image transfer step and being positioned relative to the other layers so as to allow imagewise transfer of said dye to said image receiver.

2. The element of claim 1 wherein the dyes of said dye layer are sublimable.

3. The element of claim 1 which said dye layer is thermally adhesive.

4. The element of claim 1 further comprising a thermal adhesive layer as an exterior face of said element adjacent to said dye layer.

5. The element of claim 3 further comprising a stripping layer between said support and said dye layer.

6. The element of any of claims 1–5 further comprising an image-receiving layer that functions as said image receiver.

7. The element of any of claims 1–5 wherein said dye layer contains dispersed therein a pigment capable of absorbing said light or infrared radiation and thereby increasing the heating effect of said radiation.

8. The element of any of claims 1–5 wherein the location of the pattern of the dye layer is oriented to perforations in said imaging element.

9. A method of forming a color image using a color transfer imaging element according to claim 1 comprising:

selectively exposing the imaging layer of said imaging element to form an infrared- or light-absorbing or -scattering image corresponding to a desired dye image, the absorption of said infrared- or light-absorbing or -scattering image varying inversely with the amount of dye desired to be transferred;

if said element does not comprise an image receiver, juxtaposing said imaging element with an image receiver so that image dye transfer can take place; and then overall exposing said infrared- or light-absorbing or -scattering image to infrared radiation or light at an intensity and for a time sufficient, thereby causing imagewise transfer of dye to the image receiver.

10. The method of claim 9 wherein said overall exposing step comprises exposure of said imaging element with an infrared lamp.

11. The method of claim 9 wherein said overall exposing step comprises exposure of said imaging element with a high intensity light flash.

12. The method of any of claims 9 to 11 further comprising the step of, after said overall exposing step, heating said image receiver sufficiently to fix said transferred dye thereto or therein.

13. The method of any of claims 9 to 11 wherein the selective exposure of said imaging element is oriented to perforations in the imaging element.

* * * * *